US008022827B2

(12) United States Patent
Rossman et al.

(10) Patent No.: US 8,022,827 B2
(45) Date of Patent: Sep. 20, 2011

(54) OMNIDIRECTIONAL RFID ANTENNA

(75) Inventors: Court E. Rossman, Merrimack, NH (US); Zane Lo, Manchester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 528 days.

(21) Appl. No.: 11/919,203

(22) PCT Filed: Oct. 11, 2006

(86) PCT No.: PCT/US2006/039599

§ 371 (c)(1), (2), (4) Date: Oct. 23, 2007

(87) PCT Pub. No.: WO2007/047277

PCT Pub. Date: Apr. 26, 2007

(65) Prior Publication Data

US 2009/0303002 A1 Dec. 10, 2009

Related U.S. Application Data

(60) Provisional application No. 60/726,146, filed on Oct. 13, 2005.

(51) Int. Cl.

| | |
|---|---|
| ***G08B 13/14*** | (2006.01) |
| ***H01Q 7/08*** | (2006.01) |
| ***H01Q 1/48*** | (2006.01) |

(52) U.S. Cl. ..... 340/572.7; 340/572.1; 343/778; 343/846; 343/841

(58) Field of Classification Search ..... None
See application file for complete search history.

(56) References Cited

U.S. PATENT DOCUMENTS

| | | | | |
|---|---|---|---|---|
| 4,207,622 | A * | 6/1980 | Miller | 367/126 |
| 5,732,579 | A * | 3/1998 | D'Hont et al. | 70/278.2 |
| 6,970,089 | B2 * | 11/2005 | Carrender | 340/572.4 |
| 7,158,033 | B2 * | 1/2007 | Forster | 340/572.1 |
| 7,420,512 | B2 * | 9/2008 | Lannon et al. | 343/700 MS |
| 7,430,397 | B2 * | 9/2008 | Suda et al. | 455/7 |
| 7,498,940 | B2 * | 3/2009 | Pettus | 340/572.1 |
| 7,546,142 | B2 * | 6/2009 | Ginzburg et al. | 455/552.1 |
| 7,574,214 | B2 * | 8/2009 | Perets et al. | 455/450 |
| 2002/0057218 | A1 * | 5/2002 | Smith | 342/365 |
| 2004/0106967 | A1 * | 6/2004 | Von Arx et al. | 607/60 |
| 2007/0080781 | A1 * | 4/2007 | Ginzburg et al. | 340/7.21 |

* cited by examiner

*Primary Examiner* — Jennifer Mehmood
*Assistant Examiner* — Fekadeselassie Girma
(74) *Attorney, Agent, or Firm* — Daniel J. Long; Robert K. Tendler

(57) ABSTRACT

Antennas (50) for RFID tags are made to exhibit circular polarization to give the tag an omnidirectional characteristic. The antennas are crossed dipoles (52,54) with respective feed points (56,58). The signal source (60) is coupled to a splitter (62) having output leads (64) directly coupled to the feed point (56) of dipole (52). The other output leads (66) from splitter (62) are coupled to a delay line (68) with the delayed output coupled to a feed point (58) of dipole (54).

4 Claims, 6 Drawing Sheets

Total Gain = Sum of LHCP and RHCP Gain

OMNIDIRECTIONAL RFID ANTENNA

RELATED APPLICATIONS

This Application claims rights under 35 USC §119(e) from U.S. application Ser. No. 60/726,146 filed Oct. 13, 2005, the contents of which are incorporated herein by reference. This application is related to three U.S. Applications: U.S. Application Ser. No. US2006/033111 filed Aug. 24, 2006 by Kenneth R. Erikson of Henniker, N.H., entitled "RFID Tag and Method and Apparatus for Manufacturing Same;" U.S. Application Serial No. US2006/033048 filed Aug. 24, 2006 by Court Rossman of Merrimack, N.H., Zane Lo of Merrimack, N.H., Roland Gilbert of Milford, N.H. and John Windyka of Amherst, N.H., entitled "Methods for Coupling an RFID Chip to an Antenna;" and U.S. Provisional Application No. 60/726,145, filed Oct. 13, 2005 by Karl D. Brommer of Exeter, N.H. and Kenneth R. Erikson of Henniker, N.H., entitled "RFID Tag Incorporating at Least Two Integrated Circuits." The contents of these three applications are incorporated herein by reference.

FIELD OF THE INVENTION

This invention relates to Radio Frequency Identification (RFID) tags and more particularly an omnidirectional RFID antenna that improves the performance of the RFID tag.

BACKGROUND OF THE INVENTION

RFID tags are becoming a well established method for tracking materials during shipping and storage. In many applications they replace the printed bar code labels on items because they do not require a close proximity for the automatic reader. In the usual tag interrogation process, a reader or interrogator projects energy towards the item to be tracked, with the energy picked up by an antenna on the tag and transferred to the integrated circuits utilized to transmit specific item information back through the antenna to the reader.

In most cases the reader employs a dipole antenna, which is linear in polarization. The tag itself usually is provided with a linearly polarized antenna such as a loop or dipole and may have an arbitrary orientation relative to the ground. Since the linear polarization makes the tag directional, this presents problems when transmitting from the reader to the tag and vice versa. The polarization may be rotated 90 degrees from the reader antenna, or the dipole radiation may have a null in the radiation pattern pointed toward the reader. It would therefore be desirable to provide a tag with gain in all directions to be able to guarantee communications between the reader and the tag.

More particularly, most RFID tags employ a linearly polarized antenna. It will be appreciated that the orientation of the tag is not known, which means that there will not be optimal efficiency in transferring the energy from the reader to the integrated circuits in the tag or for that matter optimally transmitting the information from the tag back to the reader.

RFID tags come in both active and passive forms. In the passive form, the tag is parasitically powered by the energy from the reader or interrogator. Because of the diodes within the rectennas utilized in the tags, there is a threshold level that must be exceeded so that the integrated circuits in the tag can be powered.

In an extreme example, if the linearly polarized antenna for the reader is orthogonal to the linearly polarized antenna of the tag, then no energy will transfer from the reader to the tag.

Not only will communication between the two be impossible, it will not be possible to parasitically power the tag.

Since the orientation of the tag relative to the reader is not easily controlled, it is important to be able to have an omnidirectional antenna located on the tag so that energy is transferred efficiently between the reader and the tag.

SUMMARY OF INVENTION

In order to make a tag having an orientation-independent response relative to the reader, the antenna for the tag is designed to have a circular polarization. If the reader also has a dual circularly polarized antenna, then a maximum amount of power is transferred between the two antennas. Circular polarization is optimal because the rotation of the tag does not matter, and circular polarization is optimal because there are no nulls in the radiation pattern, which occurs if one uses linear polarization.

If the transmit antenna is circularly polarized and the tag is linearly polarized, then the circularly polarized transmit antenna transfers considerably less than maximum power to the linearly polarized receive antenna.

The same is true if the reader has a linearly polarized transmit antenna and the tag has a circularly polarized receive antenna.

In either case, it is important that one or the other of the antennas be circularly polarized so that at the very least there will be some energy transferred from one antenna to the other. If both antennas were linearly polarized and orthogonal one to the other, then no energy transfer would be possible, whereas if both antennas are linearly polarized and parallel to each other, then a maximum amount of energy would be transferred therebetween.

In short, while one loses up to 3 dB or half the power when converting between linear and circular polarizations, there is at least a guarantee that no less than half of the energy from one antenna will be transferred to the other antenna.

Circular polarization means that there is a vertical and a horizontal E-field vector that are 90° out of phase. Thus when one transmits from a linearly polarized antenna, such as a dipole, to a circular polarized antenna, the circularly polarized antenna is only picking up the same polarization that was incident on it from the dipole. Note that the circularly polarized antenna is optimized to receive both polarizations at once.

For orientation-independent systems in which random orientations of the tags are contemplated, providing a circularly polarized antenna on the tag guarantees coverage even though one can lose half of the power going from a linear to a circular polarization.

Of course, if the reader were provided with a circularly polarized antenna, one would not need to know the orientation of the tag relative to the reader if the tag had a circularly polarized antenna. However, the circularly polarized tag will radiate left hand CP in one direction and right hand CP in the opposite direction. Hence the reader to needs try both senses of CP to optimize coupling. Thus ideally the antenna for the interrogator or reader should be circularly polarized and switchable from left-hand circular polarization to right-hand and vice versa.

It is noted that most if not all RFID readers utilize a dipole transmit antenna, and that these antennas are linearly polarized. RFID tags that utilize simple loop antennas are also linearly polarized.

At least for the tag antenna, one therefore needs some sort of antenna that has is omnidirectional, with both vertical and horizontal polarizations 90° out of phase. If the polarizations are not out of phase, the antenna would exhibit a 45° linear polarization. Thus the 90° phase difference is critical in providing an omnidirectional antenna.

The simplest type of circularly polarized antenna involves utilizing a crossed dipole. In this, case the dipole elements are oriented at 90°, with one of the dipoles being fed 90° out of phase with the other of the dipoles. While one could devise a phase splitter arrangement having two outputs, one 90° out of phase with the other, in one embodiment of the subject invention a 90° phase delay is provided through the use of a delay line. Thus both of the crossed dipoles are fed from a common source, but the signal to one dipole travels an elongated path with respect to the other dipole. The length of the path is one-quarter wave longer to one dipole than the other, such that the delay is provided by a delay line that is 90° long.

Because the size of the tags must be minimized, especially in item-level tagging, it is important to make the tag itself small, which means reducing the size of the tag antenna. To reduce the size, in one embodiment, the crossed dipole antenna that offers an omnidirectional pattern and circular polarization has the ends of the dipoles spiraled back on themselves so as to minimize the lateral extent of the dipole.

Note that as to antenna size, a standard circularly polarized antenna is the single-feed spiral antenna, with two spiraling arms. However, a spiral is also larger than a crossed dipole because the spiral in CP mode needs to be a traveling wave mode, and hence is electrically large. Hence a spiral is larger and has more bandwidth than is needed for RFID at 915 MHz. A CP spiral would be 10 cm side length to radiate CP at 915 MHz, using 4 turns per arm of the spiral.

A loop fed using the same 90 degree delay line would be larger than the cross dipoles fed using the 90 delay line. An inductively loaded loop needs to be 10 cm side length to radiate CP at 915 MHz, in a planar design using meander lines to inductively load the loop.

On the other hand, advantageously, a crossed dipole, folded like a single turn spiral, has only a 6 cm side length to radiate CP at 915 MHz, as described in this invention.

As one seeks to engineer smaller and smaller antennas for smaller and smaller tags, if the antenna dipoles are not a half wave, then there is a reactance for the antenna such that the antenna is not tuned to the output impedance of the RFID integrated circuit microradio chip employed.

This non-optimal half wavelength design can affect VSWR and can affect the ability to create circular polarization. For certain detuning situations, for instance the right-hand circular polarization might prevail over the left-hand circular polarization in which energy in the right-hand circular polarization goes into cross-polar operation. It is the purpose of the tuning to make sure that energy goes into the co-polarization versus the amount of energy that goes into cross-polarization. With perfect tuning, there would be very little if any energy in the right-hand circular polarization or cross-polarization mode. However, in practical antennas the 90° delay line is not perfectly optimized such that the vertical and horizontal polarizations are not of equal magnitude. This means that the amplitude of the signals in the second dipole may be smaller than the amplitude of the signals in the first dipole.

While precise circular polarization is not critical, what is important is to have some horizontal polarization and some vertical polarization to provide some circular polarization.

Note that if there is imperfect circular polarization, then the tag is going to exhibit a certain amount of directivity due to a certain amount of linear polarization. Accidentally, it could be that this linear polarization could be in the same direction as the polarization of the transmit antenna of the reader. However, it might also be that the linear polarization direction is 90° rotated from the polarization direction of the reader in which one would get poor reception.

Of course, if the transmit antenna for the reader were circularly polarized, then any imperfection in the circular polarization of the tag antenna would have very little effect.

In the spiral antenna embodiment, a 1.7:1 SWR is achieved, with the antenna having a 10% bandwidth that meets the requirement of current RFID tags. The antenna could be fabricated with a larger bandwidth if the tag size were allowed to increase. However, since RED tag protocols require a bandwidth narrower than 10%, the tag antenna could actually be made smaller. This is because the size of the antenna is directly related to bandwidth.

In summary, antennas for RFID tags are made to exhibit circular polarization to give the tag an omnidirectional characteristic.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
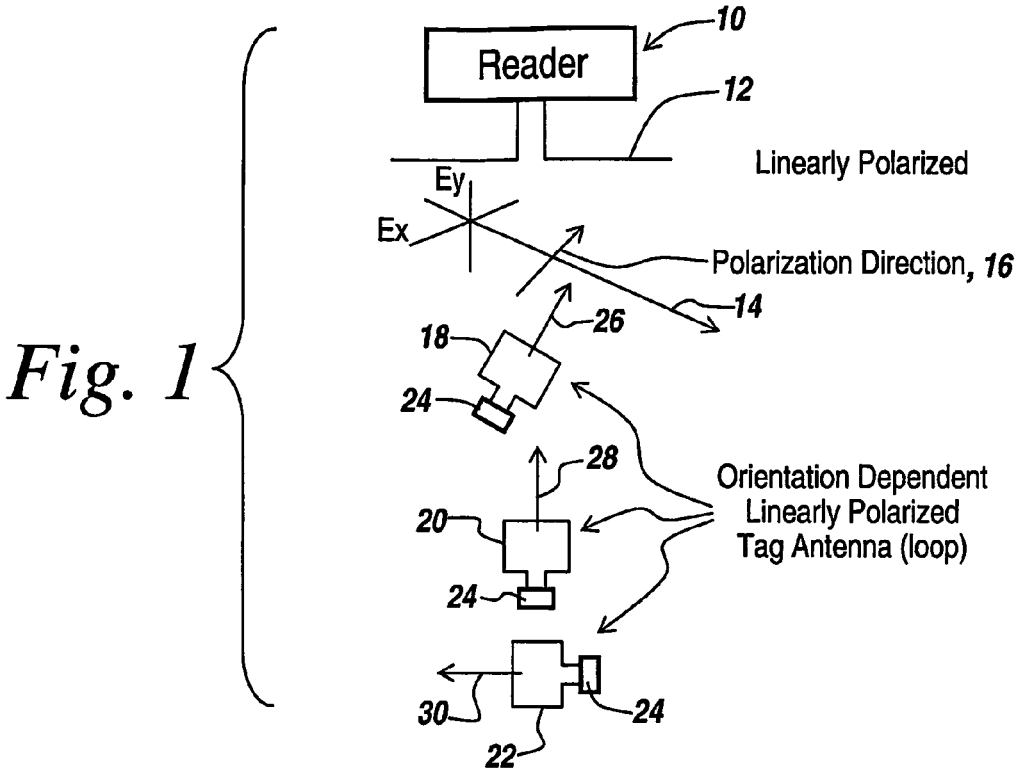
FIG. 1 is a diagrammatic illustration of the effect of a linearly polarized reader or probing source having a linearly polarized antenna on randomly oriented RFID tags having linearly polarized antennas.

What is now presented is a description of antenna polarization and the effects of polarization mismatch loss.

Antenna Polarization

The energy radiated by any antenna is contained in a transverse electromagnetic wave that is comprised of an electric and a magnetic field. These fields are always orthogonal to one another and orthogonal to the direction of propagation.

The electric field of the electromagnetic wave is used to describe its polarization and hence, the polarization of the antenna.

In general, all electromagnetic waves are elliptically polarized. In this general case, the total electric field of the wave is comprised of two linear components, which are orthogonal to one another. Each of these components has a different magnitude and phase. At any fixed point along the direction of propagation, the total electric field would trace out an ellipse as a function of time. At any instant in time, $E_x$ is the component of the electric field in the x-direction and $E_y$ is the component of the electric field in the y-direction. The total electric field E, is the vector sum of $E_x$ plus $E_y$.

Two special cases of elliptical polarization are circular polarization and linear polarization. A circularly polarized electromagnetic wave is comprised of two linearly polarized electric field components that are orthogonal, have equal amplitude and are 90 degrees out of phase. In this case, the polarization ellipse bound by the tip of the E-field vector is a circle. Depending upon the direction of rotation of the circularly polarized wave, the wave will be left hand circularly polarized or right hand circularly polarized. The phase relationship between the two orthogonal components, +90 degrees or −90 degrees, determines the direction of rotation.

A linearly polarized electromagnetic wave is comprised of a single electric field component and the polarization ellipse formed by the tip of the E-field vector is a straight line.

The term used to describe the relationship between the magnitude of the two linearly polarized electric field components in a circularly polarized wave is axial ratio, which is defined as the ratio of the maximum to the minimum cross sections of the ellipse. In a pure circularly polarized wave both electric field components have equal magnitude and the axial ratio, AR, is 1 or 0 dB (10 log [AR]). In a pure linearly polarized wave the axial ratio is ∞.

Polarization Mismatch Loss

In order to transfer maximum energy or power between a transmit and a receive antenna, both antennas must have the same spatial orientation, the same polarization sense and the same axial ratio. When the antennas are not aligned or do not have the same polarization, there will be a reduction in energy or power transfer between the two antennas. This reduction in power transfer will reduce the overall system efficiency and performance.

When the transmit and receive antennas are both linearly polarized, physical antenna misalignment will result in a polarization mismatch loss which can be determined using the following formula:

$$\text{Polarization Mismatch Loss (dB)} = 20 \log(\cos \theta) \quad (1)$$

where θ is the misalignment angle between the two antennas. Table 1 illustrates some typical mismatch loss values for various misalignment angles.

TABLE 1

Polarization Mismatch Between Two Linearly Polarized Waves as a Function of Angular Orientation.

| Orientation Angle | Polarization Mismatch (dB) |
|---|---|
| 0.0 (aligned) | 0.0 |
| 15.0 | 0.3 |
| 30.0 | 1.25 |
| 45.0 | 3.01 |
| 60.0 | 6.02 |
| 76.0 | 11.74 |
| 90.0 (orthogonal) | ∞ |

One of the common misconceptions regarding polarization relates to the circumstance where one antenna in a transmit-to-receive circuit is circularly polarized and the other is linearly polarized. It is generally assumed that a 3 dB system loss will result because of the polarization difference between the two antennas. In fact, the polarization mismatch loss between these two antennas will only be 3 dB when the circularly polarized antenna has an axial ratio of 0 dB. The actual mismatch loss between a circularly polarized antenna and a linearly polarized antenna will vary depending upon the axial ratio of the circularly polarized antenna.

When the axial ratio of the circularly polarized antenna is greater than 0 dB, this indicates that one of the two linearly polarized components will respond to a linearly polarized signal more so than the other component will. When a linearly polarized wave is aligned with the circularly polarized linear component with the larger magnitude, the polarization mismatch loss will be less than 3 dB. When a linearly polarized wave is aligned with the circularly polarized linear component with the smaller magnitude, the polarization mismatch loss will be greater than 3 dB. Table 2 illustrates the minimum and maximum polarization mismatch loss potential between a circularly polarized antenna and a linearly polarized antenna as a function of axial ratio.

TABLE 2

Polarization Mismatch between a Linearly and Circularly Polarized Wave as a Function of the Circularly Polarized Wave's Axial Ratio.

| Axial Ratio | Minimum Polarization Loss (dB) t | Maximum Polarization Loss (d/B) tt |
|---|---|---|
| 0.00 | 3.01 | 3.01 |
| 0.25 | 2.89 | 3.14 |
| 0.50 | 2.77 | 3.27 |
| 0.75 | 2.65 | 3.40 |
| 1.00 | 2.54 | 3.54 |
| 1.50 | 2.33 | 3.83 |
| 2.00 | 2.12 | 4.12 |
| 3.00 | 1.77 | 4.77 |
| 4.00 | 1.46 | 5.46 |
| 5.00 | 1.19 | 6.19 |
| 10.00 | 0.41 | 10.41 |

t Minimum polarization loss occurs when the strongest linear field component of the circularly polarized wave is identically aligned with the linearly polarized wave.
tt Maximum polarization loss occurs when the weakest linear field component of the circularly polarized wave is identically aligned with the linearly polarized wave.

An additional issue to consider with circularly polarized antennas is that their axial ratio will vary with observation angle. Most manufacturers specify the axial ratio at the antenna boresight or as a maximum value over a range of angles. This range of angles is generally chosen to represent the main beam of the antenna. In order to measure axial ratio, antenna manufacturers measure the antenna radiation pattern with a spinning linearly polarized source. As the source antenna spins, the difference in amplitude between the two linearly polarized wave components radiated or received by the antenna is evident. The resulting radiation pattern will describe the antenna's axial ratio characteristics for all observation angles.

From the antenna radiation pattern, it can be demonstrated that the axial ratio at boresight is about 2.5 dB, while at an angle of 60 degrees off boresight, it ranges from about 5 to 8 dB. This illustrates that since axial ratio varies with observation angle, the polarization mismatch loss between a circularly polarized antenna and linearly polarized antenna will vary with observation angle as well.

For any planar CP antenna without a ground plane, the sense of the CP will reverse when illuminated from the back (perpendicular to the plane of the antenna, on one particular side) as opposed to the front (perpendicular to the plane of the antenna, on the other side). When illuminated in the plane of the antenna, the polarization is completely linear.

With this restriction in mind, a CP reader should try both LH and RH polarizations in order to optimize the coupling to all the CP tags. That is, if the planar CP tag is arbitrarily oriented and happens to be radiating the, say, RHCP toward the reader, then the reader should be switched to the RHCP polarization.

If the reader can only be linear, then this CP ambiguity does not matter. The system will accept the 3 dB coupling loss (half power loss), but need accept no worse than that.

If there is a ground plane under the tag, then all the radiation will be in one sense only, and the reader only needs one sense CP. However, the antenna will now be more directive and gain will be lost in the directions behind the ground plane.

RFID Polarization Mismatch

With this discussion of polarization and the effects of polarization mismatch, and referring now to FIG. 1, in a typical RFID probing operation, a reader 10 is coupled to a linearly polarized antenna 12, which results in electromagnetic wave having orthogonal E-field components $E_x$ and $E_y$, propagating out in the direction of arrow 14. Because of the linearly polarized antenna, the antenna has a polarization direction illustrated by arrow 16.

Assuming that one has RFID tags whose orientation is random, then assuming that the RFID tags have linearly polarized antennas such as shown by loop antennas 18, 20 and 22, each with an RFID integrated circuit microradio chip 24 at the feed points thereof, then as can be seen, depending on the orientation of the loop antenna, the directions of polarization of the tags is different as illustrated at 26, 28 and 30 respectively.

What will be immediately obvious is that there is a misalignment between polarization direction 16 of the linearly polarized transmit antenna 12 and the polarization directions associated with loops 18, 20 and 22.

What this means is that if the polarization directions of the reader's transmit antenna and the RFID tag's antenna are orthogonal, little energy is transferred from the reader to the RFID tag.

For passive RFID tags, it is important that a significant amount of energy from reader 10 be efficiently coupled to power the RFID circuits. Not having sufficient amount of energy coupled into a passive tag means that diode thresholds in the antenna will not be reached. This means that the tag will not be powered and its information cannot be read out.

Figure 2:
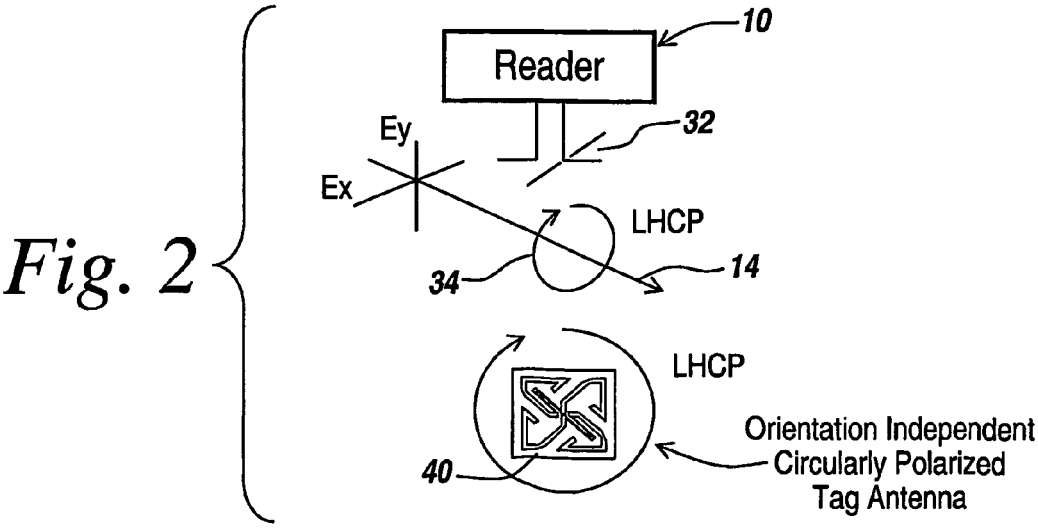
FIG. 2 is a diagrammatic illustration of the use of a circularly polarized RFID tag antenna when utilized with a reader or probing source having a circularly polarized antenna.

Referring to FIG. 2, if reader 10 is provided with a circularly polarized antenna 32, then in the propagation direction 14, one will have, for instance, a left-hand circularly polarized wave as indicated at 34.

Note that the polarization of an antenna is defined by the polarization of the wave radiated by the antenna. This wave has an oscillating electric and magnetic field. The electric field for either antenna 12 or 32 is described by an electric field vector having the orthogonal components $E_x$ and $E_y$.

Since the E-field vector varies cyclically, the figure traced by the tip of the E-field vector at a given position along the direction of propagation describes the polarization of the antenna.

Thus, in FIG. 1 one sees a linear polarization illustrated by arrow 16 with its direction indicated by the arrow. In FIG. 2 one sees a circular polarization expressed by the figure traced by the tip of the E-field vector.

It is the purpose of the subject invention to provide an omnidirectional, orientation-independent, circularly polarized tag antenna such as that shown at 40, which can be printed onto a single layer. This antenna includes crossed dipoles and a delay line that delays the input signal at the feed point of one dipole 90° relative to the input at the other dipole.

What will be seen with respect to FIG. 2 is that this particular embodiment for RFIG tag interrogation is orientation-independent because of the circularly polarized wave from the reader and the circularly polarized characteristic of the tag antenna. In this particular embodiment, a maximum amount of power will be transferred from the reader to the tag regardless of tag or reader antenna orientation.

If, however, the reader is provided with a linearly polarized antenna, it will be appreciated that by providing the RFID tag with a circularly polarized antenna, then at least some of the power from the reader is usable to power the tag.

Figure 3:
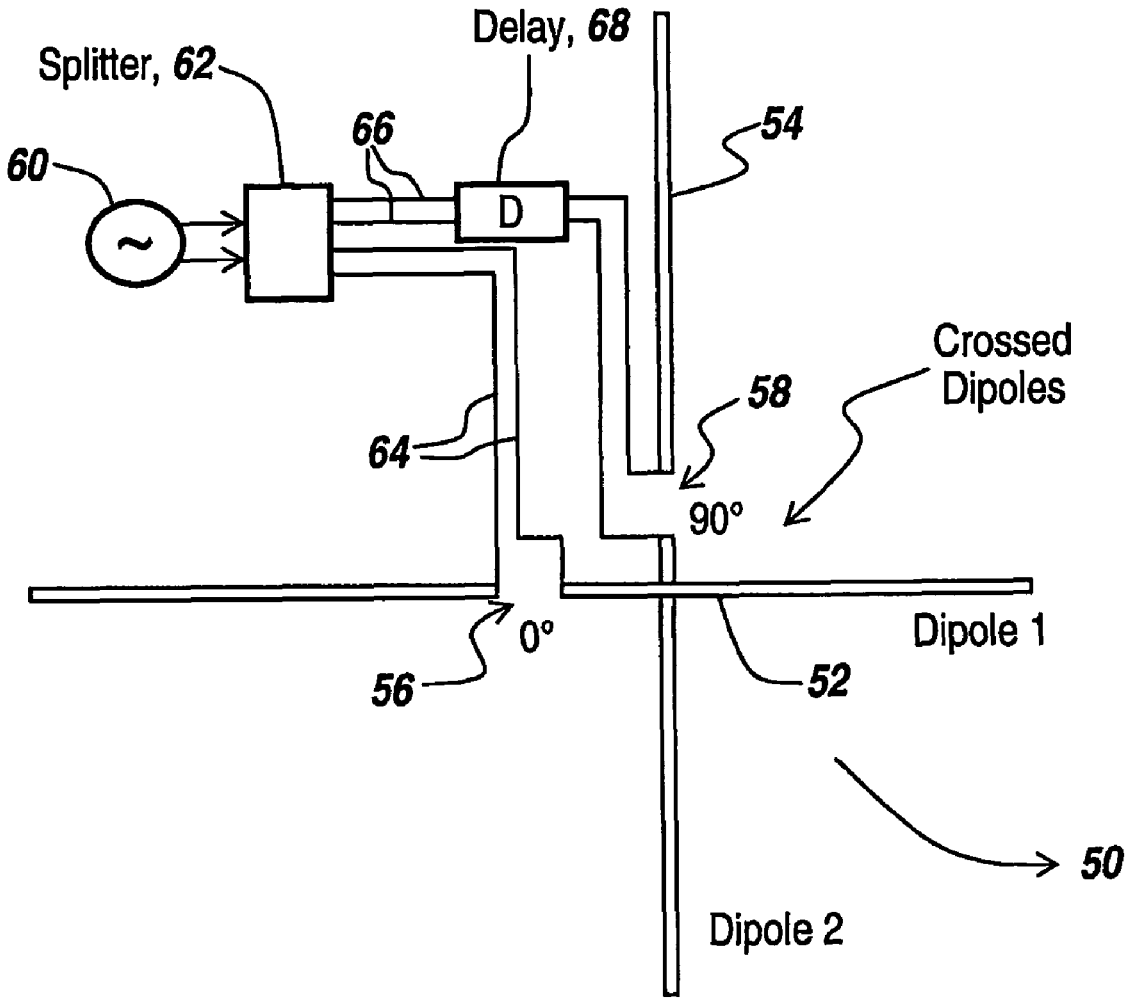
FIG. 3 is a diagrammatic illustration of one embodiment of a circularly polarized antenna for use with RFID tags, illustrating orthogonally oriented dipoles, with the feed to one of the dipoles being 90° out of phase with respect to the feed of the other dipole.

Referring now to FIG. 3, the simplest way to provide a circularly polarized antenna, here shown at 50, is to provide crossed dipoles 52 and 54 in which dipole 52 has a feed point 56, and in which dipole 54 has a feed point 58.

It is the definition of a circularly polarized antenna that the polarized electromagnetic wave is comprised of the two linearly polarized electric field components that are orthogonal, have an equal amplitude and are 90° out of phase.

In one embodiment, how this condition is derived requires a signal source 60 coupled to a splitter 62 having output leads 64 directly coupled to feed point 56 of dipole 52. The other output leads 66 from splitter 62 are coupled to a delay line 68, with the delayed output coupled to feed point 58 of dipole 54.

It is the purpose of the delay line to provide a 90° delay by imposing a transmission line that is 90° long.

Figure 4A:
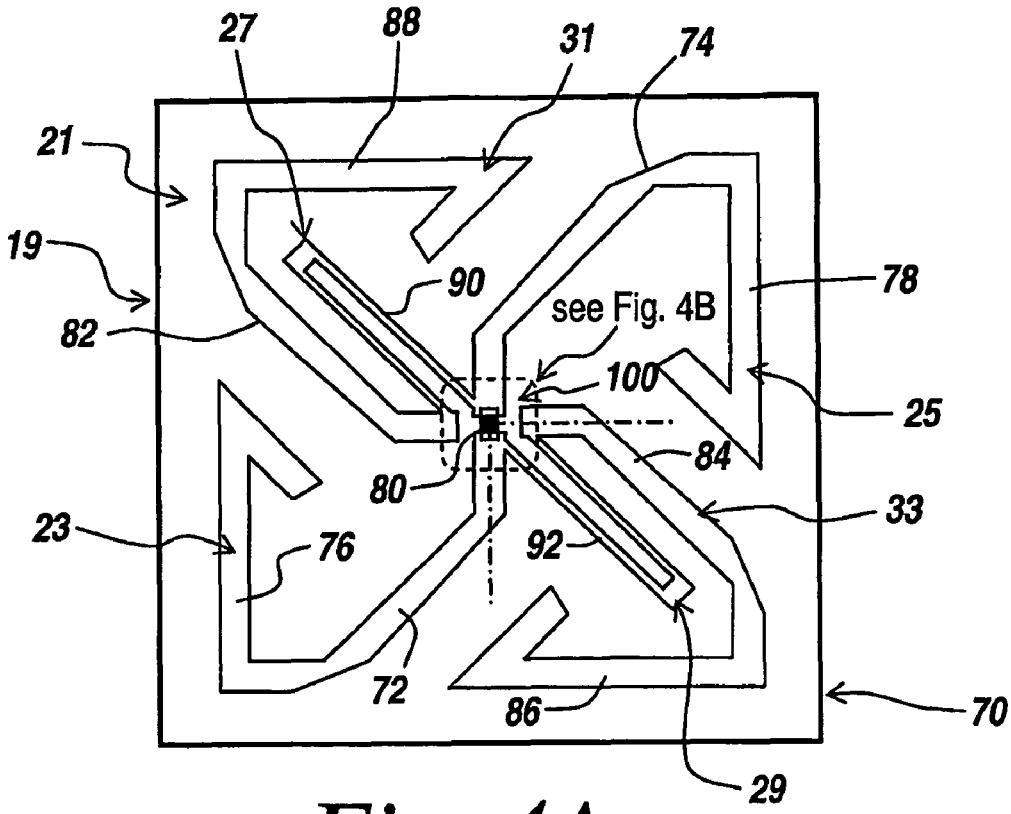
FIG. 4A is a diagrammatic illustration of a spiral dipole antenna, with the spiral used to minimize the area that the antenna occupies.

Referring to FIG. 4A, since the RFID tags need to be provided with a miniaturized antenna, at least for item-level tagging, an antenna 70 is provided with the aforementioned crossed dipoles. However, this antenna is configured in a spiral fashion to minimize the real estate occupied by the antenna itself. Here it can be seen that one of the dipoles is provided by conductive traces 72 and 74, which are spiraled on themselves at portions 76 and 78 respectively. It is this dipole that is fed directly with the output of an RFID microradio chip 80.

The other crossed dipole includes conductive traces 82 and 84, likewise spiraled in on themselves as illustrated by sections 86 and 88.

In order to provide a 90° out-of-phase signal to the dipole constructed with traces 82 and 84, a pair of delay lines 90 and 92 are connected between the feed point 100 at which the microradio is coupled, with delay line 90 comprising a trace running from one side of the feed point of the dipole constructed of traces 72 and 74 to the dipole comprised of trace 82. Delay line 92 is connected between the feed point of the crossed dipole from trace 72 to trace 84.

Figure 4B:
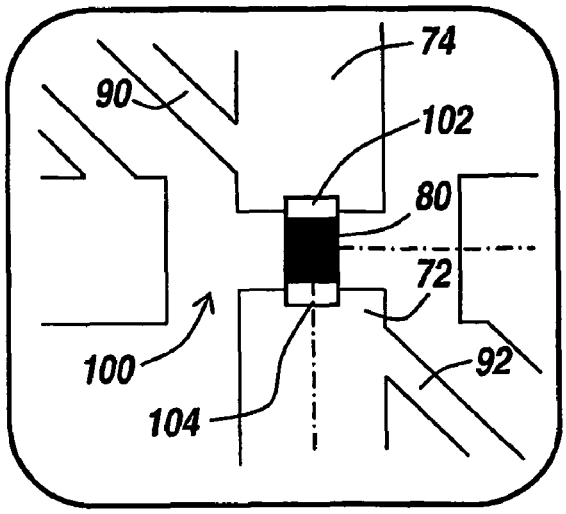
FIG. 4B is an expanded view of the feed point of the spiral dipole antenna of FIG. 4A, illustrating the direct coupling of an RFID integrated circuit microradio chip across the feed point of the antenna.

Referring to FIG. 4B, the feed point 100 for the spiral crossed dipole antenna of FIG. 4A shows that an RFID microradio chip having end connectors 102 and 104 is coupled across the end portions of traces 72 and 74. As can also be seen, the traces associated with delay lines 90 and 92 are also electrically connected to end connectors 102 and 104.

What is provided by the spiraled crossed-dipole antenna of FIG. 4A is an antenna that has a circularly polarized characteristic, assuming that the delay lines 90 and 92 are appropriately configured.

Figure 5:
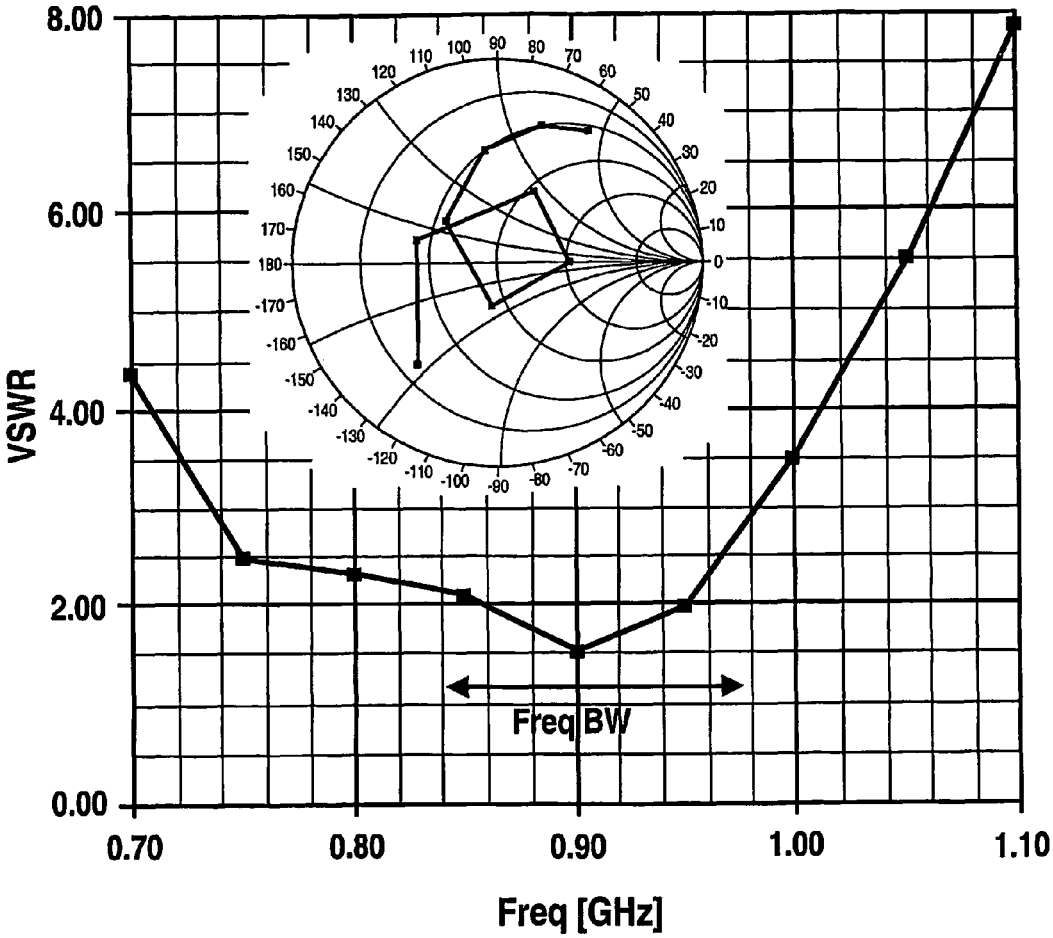
FIG. 5 is a VSWR graph of the response of the antenna of FIG. 4A, showing that within a 10% frequency bandwidth the VSWR of the antenna is below 2:1.

Referring to FIG. 5, assuming a 10% bandwidth, it can be seen that the VSWR of the antenna of FIG. 4A is below 2:1. The VSWR on the graph of FIG. 5 is computed from the Smith chart immediately above the VSWR curve.

Figure 6:
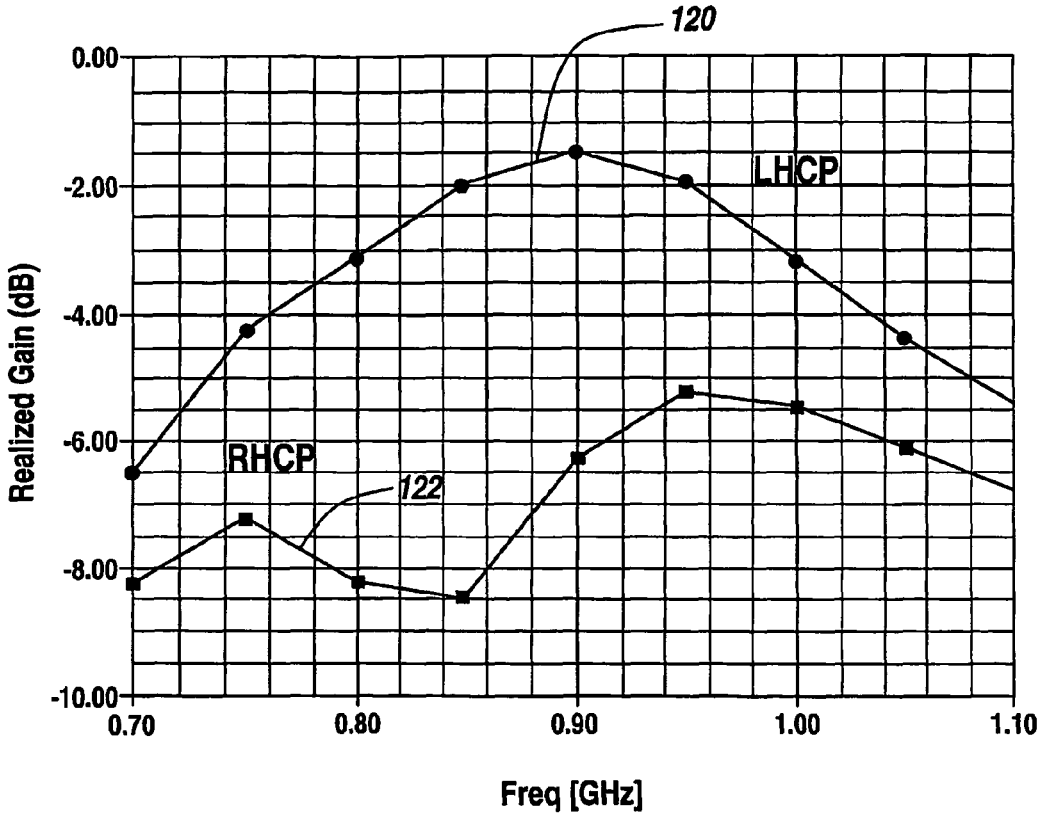
FIG. 6 is a graph of realized gain for an ideal circularly polarized antenna illustrating that for the left-hand circular polarization, the realized gain at the resonant frequency is greater than −2.00 dB, whereas for an non-ideal circular polarized antenna that results in right-hand circular polarization, the realized gain is less; and, FIG. 7 is a diagrammatic illustration of an interdigitated feed structure for the spiral dipole antenna of FIG. 4A, illustrating the depositing of a number of RFD integrated circuit microradio chips, at least some of which are properly coupled to the antenna feed.

Referring now to FIG. 6, the realizable gain of the antenna of FIG. 4A shows that, for curve 120, at the resonant frequency of the antenna, the realizable gain is greater than −2.00 dB for the left-hand circular polarization component of the antenna. This would be the only component for an ideal antenna. However, for real-world antennas, the antenna exhibits a right-hand circularly polarized component 122 such that the total gain of the antenna, being the sum of the LHCP and RHCP gains, is somewhat diminished. With proper tuning and the proper delay adjustment, trace 122 will lie much below trace 120 and therefore be negligible.

Figure 7:
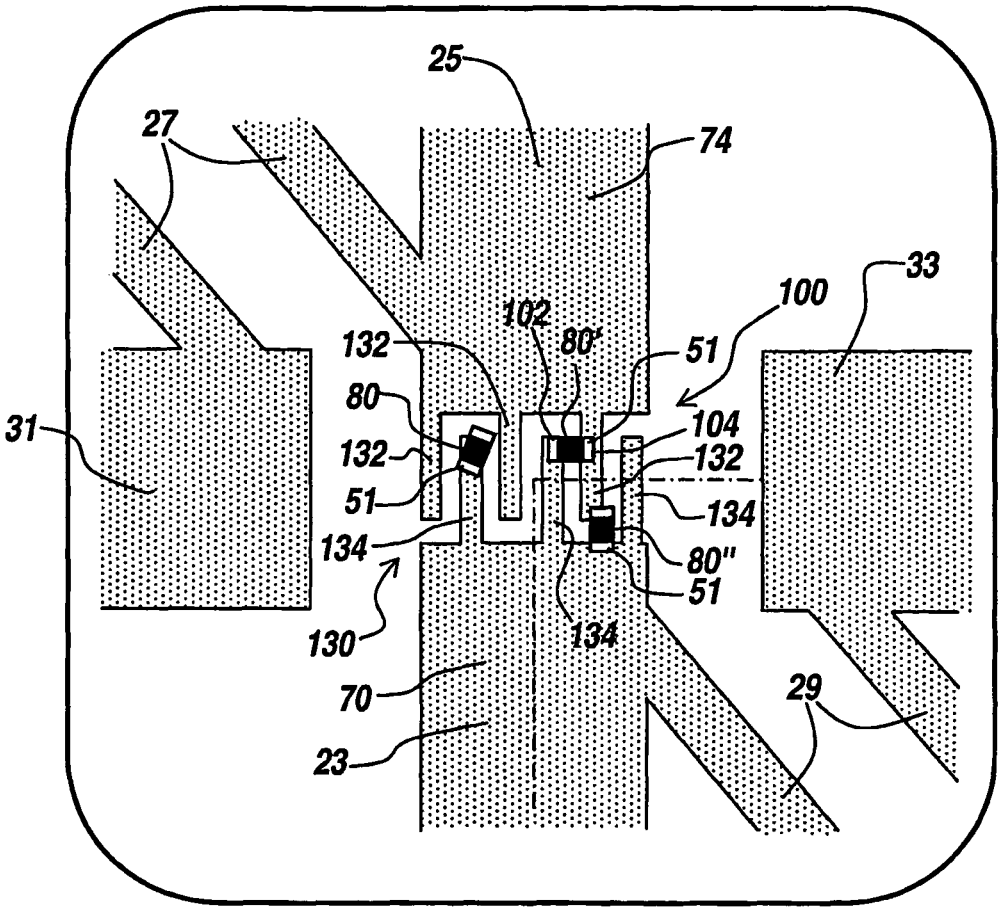

Referring now to FIG. 7, in order to take advantage of the ability to deposit multiple RFID integrated circuit microradio chips at the feed point 100 of the antenna, feed point 100 may be provided with an interdigitated structure 130, which comprises fingers or tines 132 extending from dipole trace 74, whereas the other portion of the interdigitated structure includes tines 134, which extend from trace 72 of the antenna of FIG. 4A.

The reason for the use of the interdigitated tines is that the tines provide numerous opportunities for RFID integrated circuit microradio chips 80 to properly connect across the tines. Here it can be seen that RFID integrated circuit microradio chip 80' has its end conductors 102 and 104 directly connected to tines across the gap between the associated tines 132 and 134. Likewise, RFID integrated circuit microradio chip 80" is directly connected to tine 132 and to the end of trace 72.

What will be appreciated is that, due to the interdigitated nature of the tines, the interdigitated tines offer many more possibilities for correct coupling or connection when microradio chips are deposited over the feed point, such as when they are carried in a non-conductive slurry or ink.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A tag orientation independent RFID tag system, comprising:

a reader having a transmit antenna and operable to transmit a signal to an RFID tag; and, a tag orientation independent RFID tag including an omnidirectional circularly polarized antenna, said antenna providing a single lobe omnidirectional radiation pattern provided by a crossed Pair of dipoles tuned to the RFID frequency, each of said dipoles having a feed point, said crossed dipole antennas having a spiral configuration to minimize the area occupied by the crossed dipole antennas; and, a 90° delay line phase shifter between the dipole feed points for phase shifting the signal at one feed point by 90° relative to the other feed point such that said crossed dipoles establish an omnidirectional characteristic, whereby random orientations of the tag relative to the transmit antenna do not result in enough polarization mismatch loss to preclude communication between said reader and said tag;

wherein said tag antenna includes a feed point having an interdigitated tine structure, and further including RFID microradio chips bridging across adjacent tines with opposite microradio chip ends connected to different adjacent tines.

2. The system of claim 1, wherein said transmit antenna is circularly polarized.

3. The system of claim 2, wherein said transmit antenna is linearly polarized.

4. The system of claim 1, wherein said phase shifter includes a delay line.

* * * * *